United States Patent [19]

Salmoiraghi

[11] 3,946,547

[45] Mar. 30, 1976

[54] DEVICE FOR MANIPULATING TEXTILE COPS

[76] Inventor: Angelo Salmoiraghi, Via Pergolesi 11, Milan, Italy, 20124

[22] Filed: Feb. 25, 1974

[21] Appl. No.: 445,347

[30] Foreign Application Priority Data

Mar. 14, 1973 Italy ..... 21590/73

[52] U.S. Cl. ..... 57/52

[51] Int. Cl.[2] ..... D01H 9/04

[58] Field of Search ..... 57/52, 53, 54; 242/41, 242/4

[56] References Cited

UNITED STATES PATENTS

| | | | |
|---|---|---|---|
| 3,112,601 | 12/1963 | McCullough | 57/52 |
| 3,116,586 | 1/1964 | Ingham | 57/52 |
| 3,410,406 | 11/1968 | Tsuda et al. | 57/52 X |
| 3,686,847 | 8/1972 | Vignon | 57/52 |
| 3,788,054 | 1/1974 | Haussmann et al. | 57/52 X |

*Primary Examiner*—Donald E. Watkins

[57] ABSTRACT

Device for withdrawing full cops from spindles in a drawing-twisting frame, transfering said cops to a predetermined station and inserting empty cops on said spindles, comprising a system of guides along which the full cops from the drawing-twisting frame are fed to a station for withdrawal thereof, and along which the empty cops are fed to the drawing-twisting frame, means being provided for transferring the full cops from the drawing-twisting frame to said guides and means for transferring the empty cops from the guides to the drawing-twisting frame.

4 Claims, 11 Drawing Figures

8'
8
41
41'
32
C
9
21
21
10
32
400
4
401
6
5
7
D
21
A
11
11'
42'
42

DEVICE FOR MANIPULATING TEXTILE COPS

This invention relates to a device for withdrawing the full cops from the spindles in a drawing-twisting frame, transferring said cops to a predetermined station and inserting empty cops on said spindles in place of the full cops withdrawn.

It is an object of the present invention to provide a device with a particularly simple and rational structure for accomplishing the above mentioned operations.

It is another object of the present invention to provide a device such as not to involve in practice a substantial floor space and which, therefore, can be applied also in those environments, wherein the room conformation and the arrangement for the drawing-twisting frames in the room would not substantially leave any available spaces and in any case would make the application of other known such devices very problematic.

In the prior art, a device for performing such operations is known.

According to the present invention, improvements are provided in said device relating to said prior art.

A device according to the present invention is essentially characterized in that a rail is provided at each side of the drawing-twisting frame where the full cops are being formed, this rail being supported and guided to move on a vertical plane at a constant horizontal attitude, a chain being provided, which is inserted in said rail and carries at regular intervals, corresponding to the spacing between the spindle axes, hook members for hooking and unhooking the cops depending on the cycle steps, means being also provided for causing said rail to vertically move and means for moving said hook members through the required movements for hooking and unhooking the cops and, at some height from the ground, there being provided a system of guides, along which said chains are moved with the full cops withdrawn by said rails, and along which, after moving through a determined path, the chains return to the rails after being cleared of the full cops and replenished with empty cops to be inserted on the spindles, and means being also provided for moving the chains with the full cops from the rails arrived at the level of said system of guides, so as to insert said chains on the guides, means for causing the chains to travel said path on the guides, means for withdrawing the full cops from the chains at some location of the path, means for subsequently hooking as many empty cops to the chains, and means by which as soon as a chain with full cops has been withdrawn from a drawing-twisting frame rail arrived at said level of the system of guides, on the same rail there is inserted a chain, which previously cleared of the full cops, has received the empty cops, that will be then slipped onto the spindles.

For better illustrating these and additional valuable features of the device according to the present invention, an exemplary embodiment of the device according to the invention will now be described, reference being had to the accompanying drawings in which.

Figure 4:
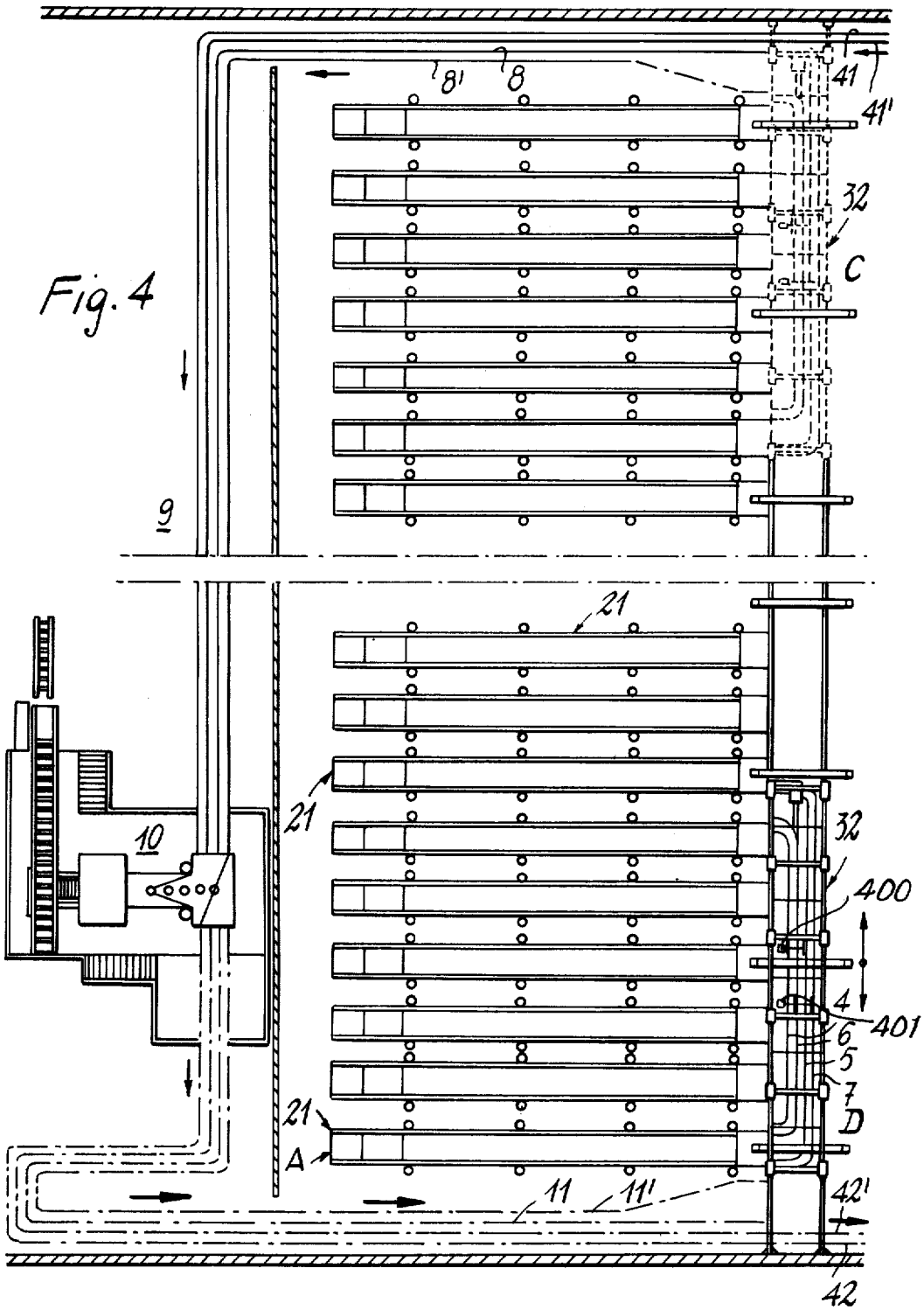
FIG. 4 is a completely schematic plan view showing a series of drawing-twisting frames and the whole guide assembly for the movements of the chains with the cops.

FIG. 4 of the accompanying drawings is a substantially schematic plan view showing drawing-twisting frames, and more particularly each of such frames are designated by reference numeral 21.

Figure 1:
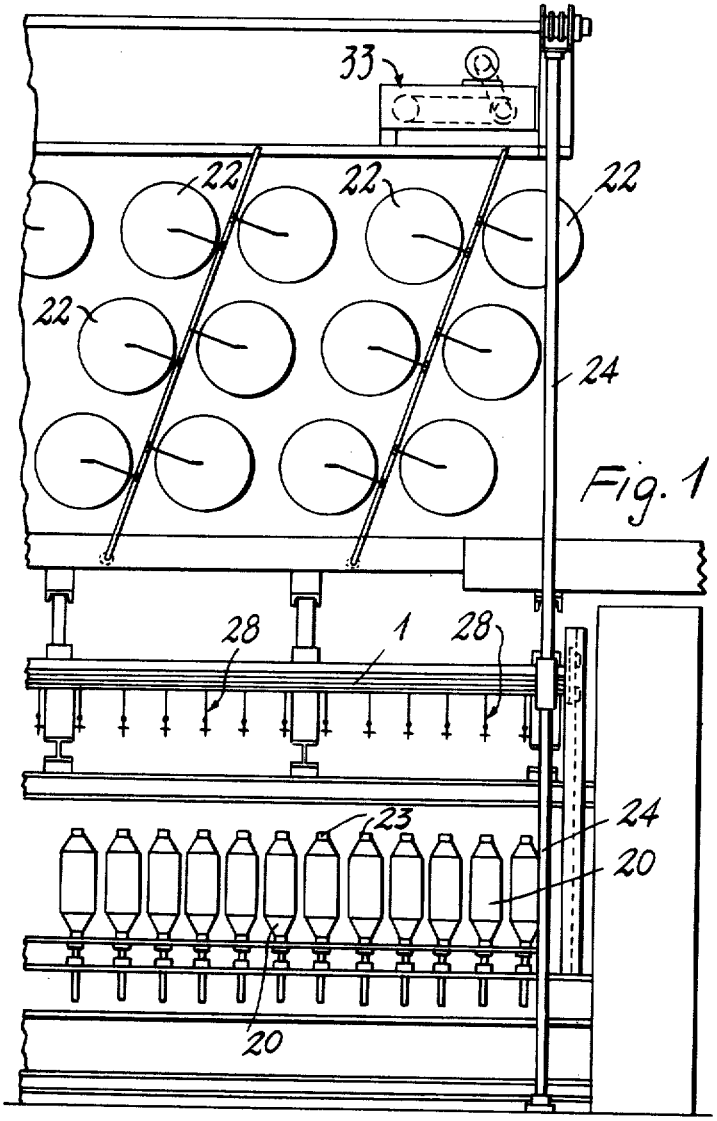
FIG. 1 is a side elevational view showing a portion of the drawing-twisting frame.
Figure 2:
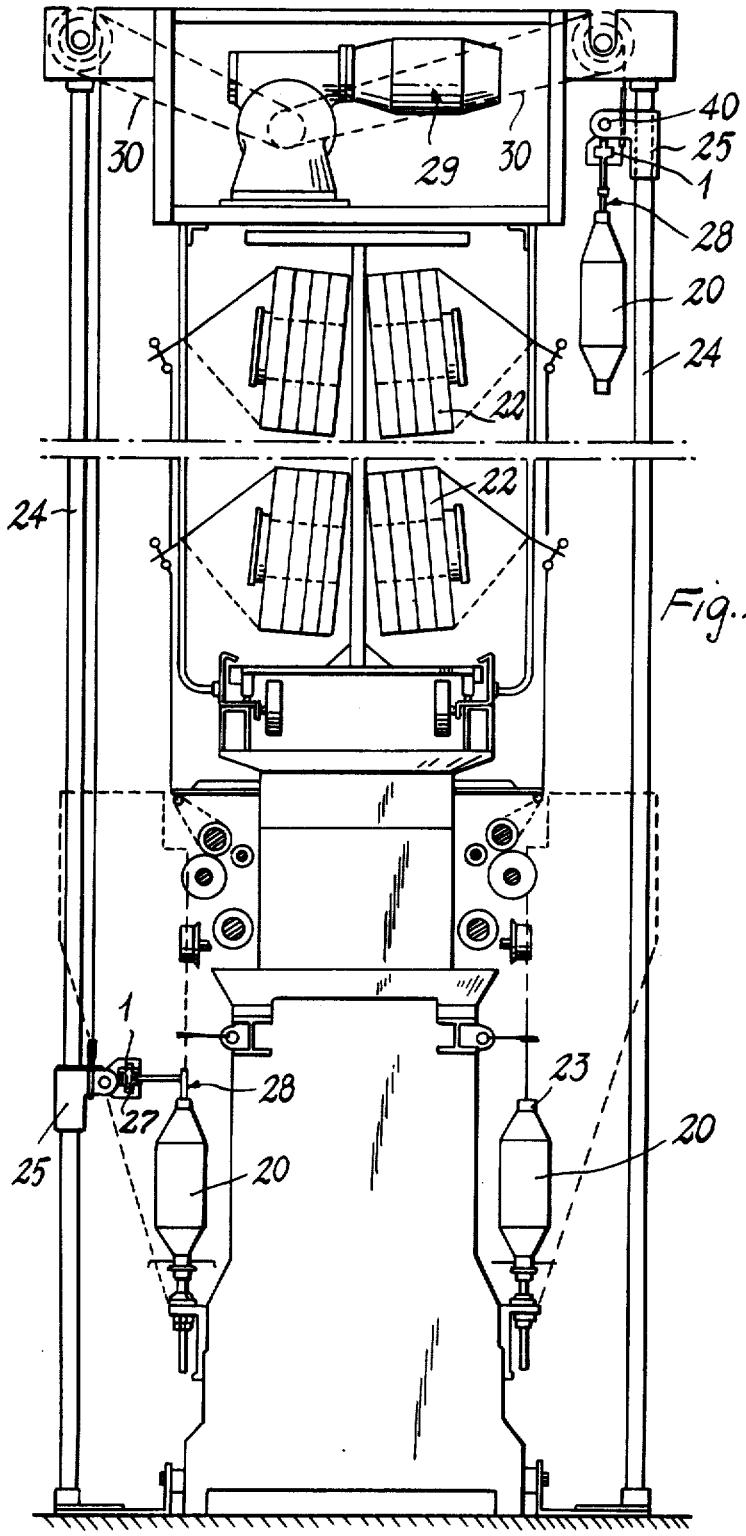
FIG. 2 is an elevation showing the drawing-twisting frame, the view being at right angles to FIG. 1.
Figure 3:
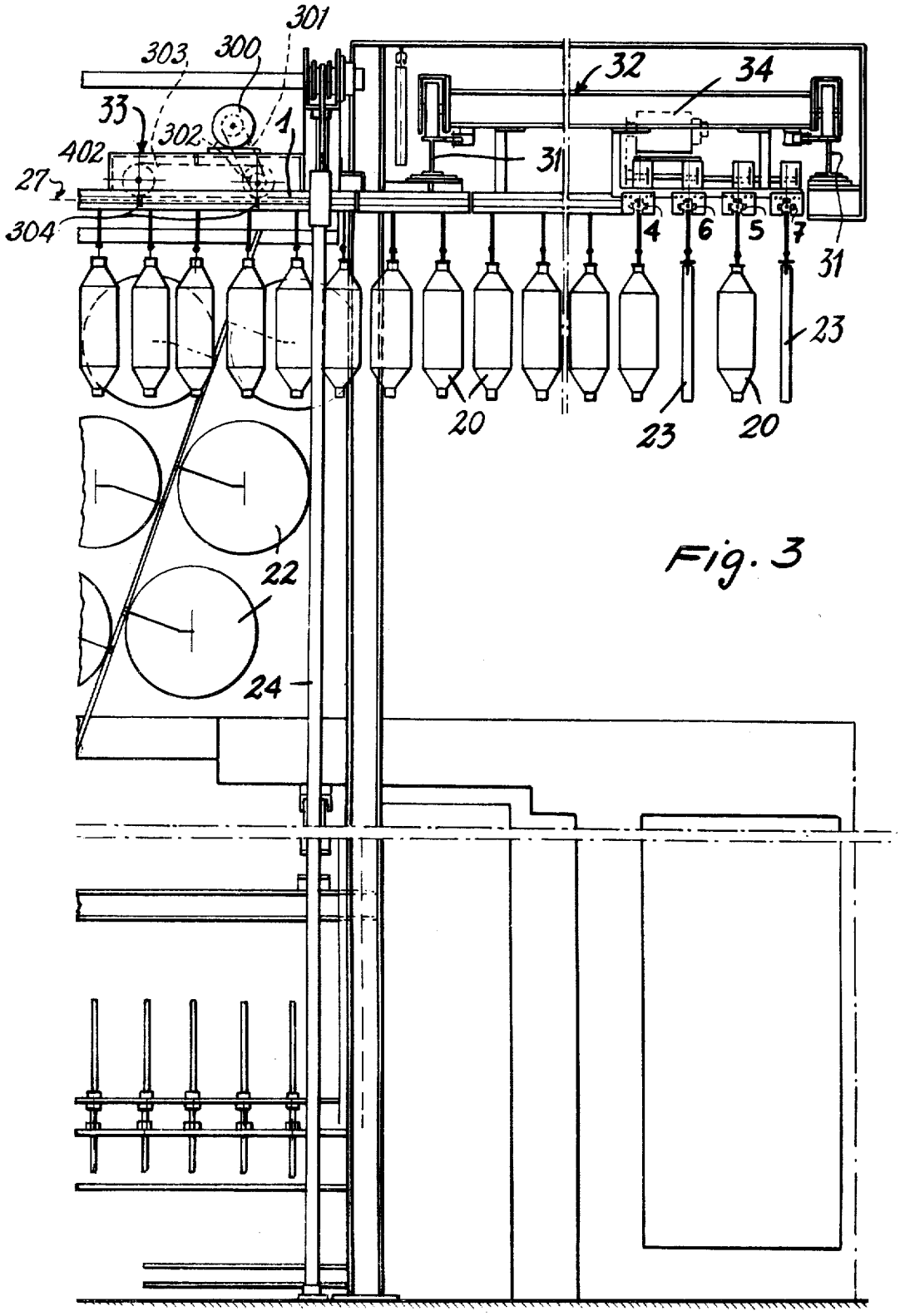
FIG. 3 is another elevational view showing a portion of the drawing-twisting frame (seen on the same side as in FIG. 1), and also showing a carriage for moving the chains with the cops.

Each of the drawing-twisting frames, which although schematically are at least partially shown in FIGS. 1, 2 and 3, comprise spools 22, from which the threads or yarns are being unwound for subsequent winding up on the cops 23 inserted on the machine spindles.

Two rows of spindles are provided on both sides of the machine, respectively.

Reference numeral 20 designates the full cops, that is those cops 23 on which the thread or yarn from the spools 22 is wound up.

The device according to the invention is adapted to withdraw the full cops 20 (which initially are at the lower part of the machine) and transfer such cops to a predetermined station and insert empty cops 23 onto the spindles, after withdrawing the full cops 20.

More particularly, said empty cops 23 are substantially tubular elements inserted on the spindles and rotably driven; said element 23 has thread or yarn wound up thereon, thus forming said full cop 20 comprising the assembly of said element 23 and thread or yarn wound up thereon.

On each of the two sides of a drawing-twisting frame in which said series of full cops 20 are formed, the device according to the present invention comprises two series of vertical guides 24 secured to the machine frame and carrying a vertically movable horizontal rail 1.

More particularly, the rails 1 are connected to a set of supports or bearings 25 sliding on said vertical fixed guides or rods 24.

As shown in FIG. 2, the rail 1 is connected to a shaft 40 extending along the front side of the machine and rotable about its horizontal geometrical axis.

The rail 1 carries a chain section 27 of a link approximately the length of the rail 1. Since each chain section 27 is merely a chain of interconnected cops, in the following discussion, the chain section 27 will be referred to as chain 27. Each chain 27 carries a series of members, designated as a whole at 28.

The members 28 are located on the chain 27 at regular intervals corresponding to the spacing between the spindle axes.

Each member 28 is a hooking member, operating for hooking or unhooking a cop, when required, as it will be explained hereinafter.

The member 28 is per se independent of the present invention and such a member, as well as the operation thereof, are not described in detail herein.

Means are provided comprising a motor 29 carried by the fixed machine frame and drive chains 30 for upwardly and downwardly move the rails 1 along with the chains carrying the gripping or hooking members 28.

Substantially, the rail 1 moves on a vertical plane, so as to reach down to the level of the full cops 20 for withdrawal thereof, as explained in the following, and to reach up to the maximum level, such as shown in FIGS. 2 and 3.

Means are also provided (for simplicity not shown and per independent of the present invention) by which, as the rail 1 moves down to the full cops 20, said rail will rotate (substantially moving to the left position as seen in FIG. 2) and the hooking members 28 will hook or grip the full cops 20; then, the rail 1 moves upward and reaches the right-hand level as seen in FIG. 2, thus rotating about the shaft 40.

For convenience, on the left side of this FIG. 2, the rail 1 is shown at the step where the full cops are withdrawn at the bottom, while on the right side of the same figure said rail 1 has been shown at the maximum level; it should be understood that the two rails on the two sides of the machine will be instead at the same steps, that is, they will conjointly move down to simultaneously withdraw the cops; then, said rails 1 will simultaneously move upward and reach said maximum level. A carriage, designated as a whole at 32, is at said level, sliding on fixed guides 31. Said carriage carries rails secured to said carriage frame at the locations shown at 4, 5, 6 and 7.

Figure 5:
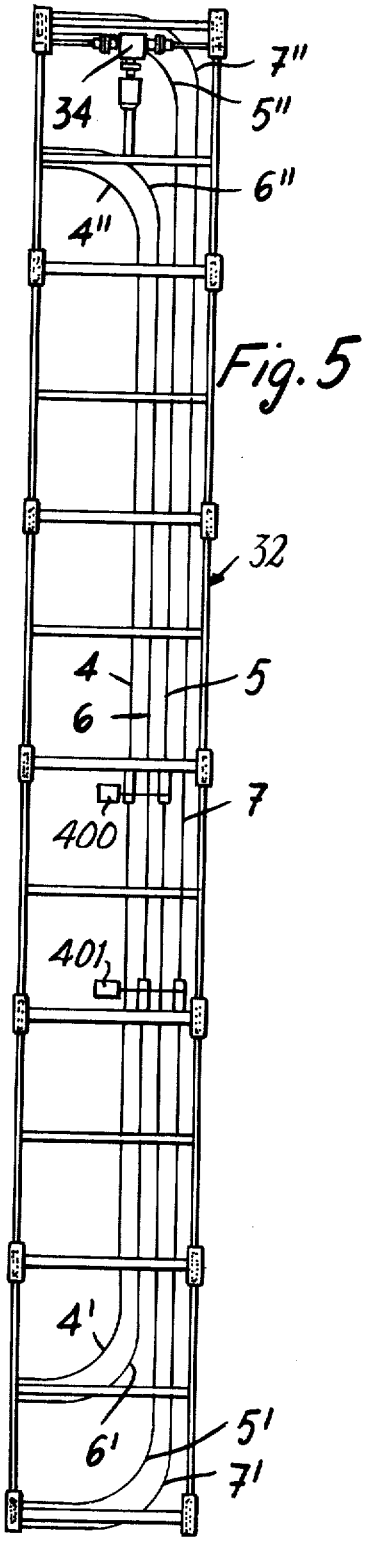
FIG. 5 is a fragmentary plan view showing a movable carriage.

Said rails are straight and parallel. At one end of the carriage 32, said rails 4, 5, 6 and 7 extend with curved rail sections 4', 5', 6' and 7', as particularly shown in FIG. 5; at the opposite end of the carriage, said rails extend in curved sections 4'', 5'', 6'' and 7''.

A thrust device is provided, designated as a whole at 33 and carried by the framework of the drawing-twisting frame, for hooking or gripping the chains 27 and operating the same, so that the chains pass from guides 1 to rails 4' and 5', from which said chains will reach to the straight rails 4 and 5.

Means 400, 401 are also provided for causing the chains to ride on said rails of the carriage 32.

Figure 11:
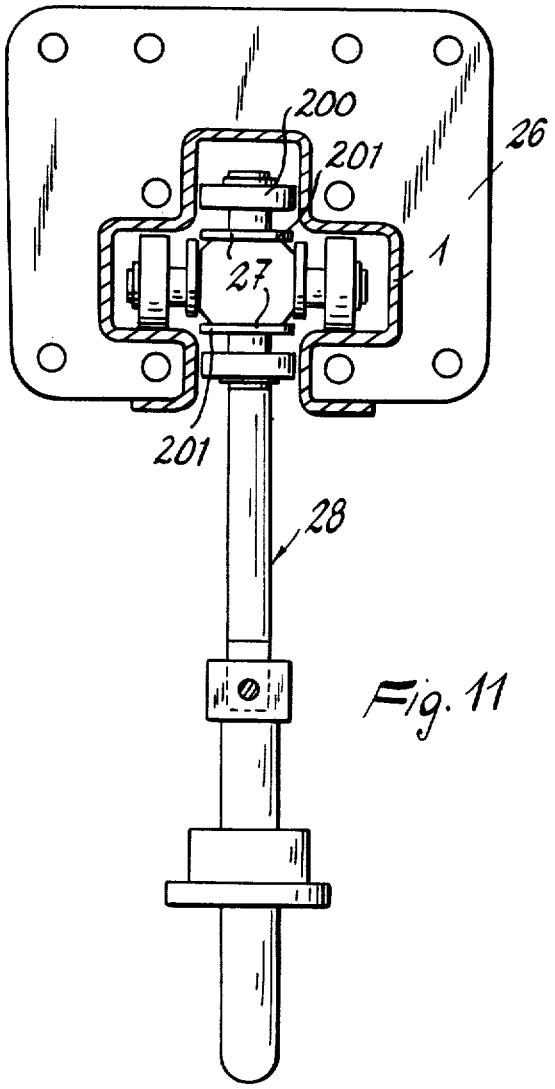
FIG. 11 shows a detail in a sectional view, showing a rail supporting a chain which, in turn, carries cops hooking members.

The means for driving the chain sections are shown in FIG. 3 of the filed drawings. In this FIG. 3, the operating means are designated at 33 and comprise a geared motor 300 which, through a belt or drive chain 301 and gear wheel 302 drive a track 303, the latter having suitably spaced apart projections 304 which, to drive the chain, engage or mesh against the upper rollers 200 of the chain (see FIG. 11). Fully similar devices are arranged throughout the circuit or path intended to be travelled by the chain. Thus, for example, the movable carriage 32 is provided with two such devices (see FIGS. 4, 5, 8 and 9) as designated at 400 and 401. The feeding device 400 is for driving the chains 27 (or the chain sections) within the guides 4 and 5 carrying the full cops, whereas device 401 is for driving the chain sections within guides 6 and 7 carrying the empty cops 23.

It should be noted that at tracks 303, provided with trailing extensions 304, the rails having the chains sliding therein are open at the top at 402 (see FIG. 3) for the passage of said trailing extensions 304.

The carriage 32 carries means comprising a motor 34 for rectilinearly moving said carriage 32 on said rails or fixed guides 31.

Substantially, at the same level of guides 4, 5, 6 and 7, there are fixed guides 8 and 8' along which, as explained hereinafter, the chains carrying the full cops are conveyed.

Said fixed guides 8 and 8' move through a predetermined path or loop, at the end of which similar fixed guides are provided, designated as a whole at 11 and 11', along which the chains unloaded of full cops and loaded with empty cops, as explained in the following, return to the carriage 32 and then to the drawing-twisting frames.

The operation of the device is substantially as follows.

Suppose a drawing-twisting frame under the conditions where the cops 23 have been filled with thread or yarn, that is the thread or yarn is wound up on said elements 23, so that full cops 20 are provided at the bottom of the drawing-twisting frame (respectively two sets of cops 20 at the two sides of the drawing-twisting frame).

Now the rail 1 is moved downwards and has inserted therein the chain 27 carrying said hooking or gripping members 28.

On moving down to a certain location, the rail 1 is rotated (see the bottom left portion of FIG. 2) and the several hooking members 28 carried by the chain will hook or grip as many full cops 20; more particularly, each of the members 28 will hook or grip said support 23.

Then, the rail 1 is moved up again, carrying along the several cops 20 hooked to said members 28 and moves upwards (location shown at the right in FIG. 2 and at the left in FIG. 3).

As above mentioned, said movements for both of the rails 1 on the two sides of the drawing-twisting frame are effectively carried out at a same time.

Suppose that this drawing-twisting frame is that designated at A in FIG. 4.

The carriage 32 is at the attitude as shown in FIG. 4 (corresponding to that shown in FIG. 3), where two of the four rails carried by the carriage 32 are aligned with the two rails 1 which, as above mentioned, have been upwardly moved.

More particularly, said two rails 1, which have been moved on both sides of the drawing-twisting frame to said up or high position, would be aligned with the rail sections 4' and 5'.

The thrust device 33 is then operated, whereby the two chains 27 located in the two rails 1 are urged on the guides or rails 4 and 5 of said carriage 32 (this movement is shown in FIG. 3).

Figure 6:
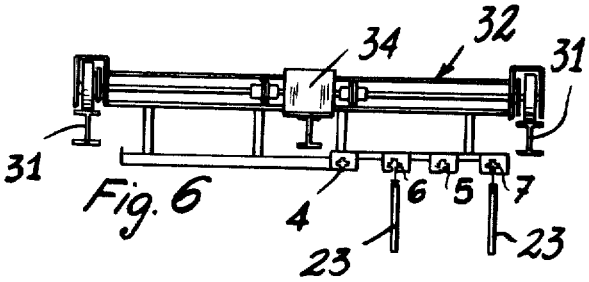
FIG. 6 is a view showing said carriage at a step where it is receiving chains with full cops.
Figure 7:
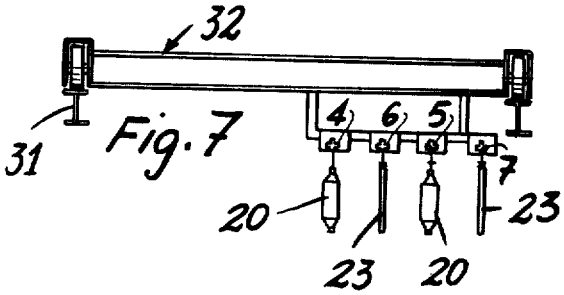
FIG. 7 is a view showing said carriage at the next step, where it has received said full cops.

Substantially, the carriage 32 is under the conditions as shown in FIG. 7, this figure showing the full cops (as carried by the corresponding chains) inserted on said guides or rails 4 and 5; previously, the carriage was under the conditions shown in FIG. 6, with the guides 4 and 5 ready to receive the chains carrying the cops.

Next, the carriage 32 moves through a short distance so that, as the guide sections 4' and 5' move away from said rails 1 (as stationary at said up or high position), the other two guide sections 6′ and 7′ will align with said rails 1.

Through further thrust members (for simplicity not shown), two chains, the function of which will become more evident in the following, being in the guides 6 and 7 of the carriage 32 and carrying empty cops 23, are drawn and particularly moved on the rails 1 in lieu of the chains formerly withdrawn with the full cops, as above mentioned.

The rails 1, having now respectively received two chains with empty cops 23, can move down and at the end of the downward movement thereof will insert or slip said empty cops 23 onto the spindles, and particularly onto those spindles from which the full cops 20 have been formerly withdrawn.

Figure 8:
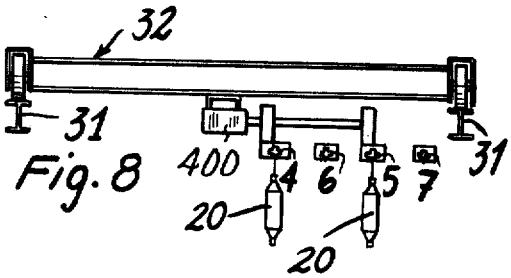
FIG. 8 is a view showing said carriage at a next step, where it has unloaded empty cops on the drawing-twisting frame.
Figure 9:
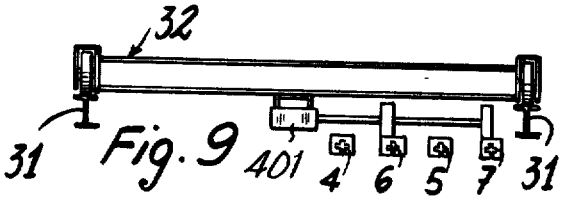
FIG. 9 is a view showing said carriage after the full cops have been inserted from the same on fixed guides.
Figure 10:
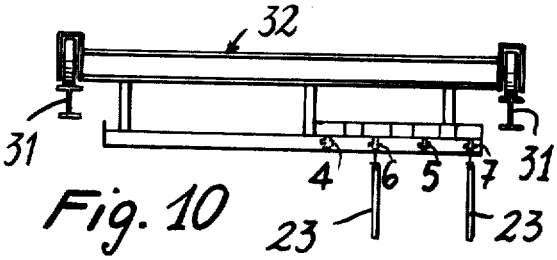
FIG. 10 is a view showing said carriage at a next step, where it has received empty cops to be inserted in a drawing-twisting frame.

Referring now again to the carriage, that although schematically is under the conditions as shown in FIG. 8 (that is carrying on two guides 4 and 5 two chains with full cops 20, while the other guides 6 and 7 do not carry any longer the chains with empty cops as having been inserted in the rails 1), said carriage will move along the room and reach the location shown at C in FIG. 4.

Through thrust members of the above design, the two chains carried by the carriage on said guides 4 and 5 and carrying the full cops 20 are urged on the fixed guides 8 and 8′, on which said chains are drawn by additional feeding systems through a given path.

Thus, the chains with the full cops arrive at a selected room at the position shown by 9 in FIG. 4, where the cops unloaded from the chains by means of conveyor belts, are sorted and the correct cops are sent to an automatic packaging machine and to an automatic boxing machine at the position shown at 10 in said FIG. 4.

Referring again to carriage 32 arrived at said postion C, following the passage of the chains with full cops from the carriage to the guides 8 and 8′, said carriage will readily move back and reach the position (such as that shown at D in said FIG. 4), where the above described operations are repeated.

Referring again to the chains carrying the full cops on the two guides 8 and 8′ and following withdrawal of said full cops from said chains, empty cops will be inserted on the chains, or more particularly, empty cops 23 intended to be carried to the preselected drawing-twisting frame will be hooked to the members 28 carried by the chains.

Said chains with empty cops travel along the fixed guides 11 and 11′ and thus can arrive at the carriage 32; more particularly, said carriage 32 is located at a position where its two guides 6 and 7 (more particularly the guide sections 6′ and 7′) are aligned with the two guides 11 and 11′ carrying the chains with the empty cops; thus and still by the thrust members, the chains with the empty cops are brought on said guides or rails 6 and 7 of carriage 32.

It is apparent that the above described operations can now be repeated, that is the carriage automatically moves to the drawing-twisting frame in readiness for doffing and its two guides 4 and 5 (more particularly the sections 4′ and 5′) are in alignment with the two drawing-twisting frame rails 1, already moved to said up or high position and carrying the full cops.

The same operations are then repeated, that is the two chains 27 carrying the full cops are urged into the two guides 4 and 5 of carriage 32; a slight displacement of the carriage occurs to align the guide sections 6′ and 7′ with said rails 1 and the two chains carrying the empty cops are urged thereon, etc.

Note that the above described device is of particularly simple and rational construction.

Therefore, the same device can serve for an entire series of drawing-twisting frames (a plurality of such drawing-twisting frames having been shown in FIG. 4) as located in a given room.

Substantially, no floor room problems would arise with the inventive device, since the carriage 32 and guide system 8, 8′ and 11, 11′ are located at the top side, as above mentioned. Additional rails 41, 41′ and 42, 42′ from another side of the room could be controlled by another bridge crane, such as that shown at 32, controlling in turn a further series of drawing-twisting frames. Among the many possible variants within the scope of the present invention, the case could also be contemplated where, instead of said carriage 32, a system of fixed guides are provided with associated switches at the drawing-twisting frames and a guide having a movable top chain with hooks for drawing the underlying chain sections carrying the cops.

What I claim is:

1. A device for manipulating textile cops, comprising:
- a plurality of drawing-twisting frames;
- a horizontal, vertical movable rail at each side of each of said frame, each of said rails having an entrance/exit end and a closed end, said rails being vertically movable from a lowered position to a raised position;
- a plurality of hook-like members spaced at predetermined intervals along said rails by interconnecting chain sections, said chain sections adapted to be longitudinally guided by said rails, said hook-like members being selectively engageable with a corresponding like number of cops;
- means for moving said rails vertically between said lowered and raised positions;
- a carriage means carrying a plurality of carriage rail sections extending normal to said vertically movable rails and having curved end portions for selective alignment with the entrance/exit ends of said vertically movable rails when said rails are in their raised positions;
- a chain section discharge station where a chain section of full cops is to be delivered;
- a chain section charging station where a chain section of empty cops is to be received; and
- means for moving said carriage means between a first position adjacent said discharge station, a second position adjacent said charging station, first intermediate positions adjacent the entrance/exit ends of selected ones of said rails for delivering chains section of empty cops thereto, and second intermediate positions adjacent the entrance/exit ends of selected other of said rails for receiving chains full cops therefrom, whereby full cops are received from said frames and delivered by said carriage means to said discharge station and empty cops are delivered by said frames from said charging station to said frames.

2. The device as set forth in claim 1, wherein the vertically movable rails on each side of each frame move in unison with each other.

3. The device as set forth in claim 1, wherein said carriage means comprises two pairs of rail sections, each rail section comprising a length of straight rail between said curved end portions; and said discharge and charging stations comprise receiving rail sections and charging rail sections, respectively, each arranged parallel to said vertically movable rails, said receiving rail having a receiving end for receiving from said carriage means chain sections containing full cops, and said charging rail having a delivery end for delivering to said carriage chain sections containing empty cops, all said receiving ends, delivery ends, and entrance/exit ends being in linear alignment transverse to said vertically movable rails, thereby to permit selective alignment between the end portions of said carriage means and said receiving, delivery, and entrance/exit ends.

4. The device as set forth in claim 1, including thrust means for moving said chain sections along said movable rail and along said carriage means.

* * * * *